United States Patent [19]

Ina et al.

[11] 4,324,217

[45] Apr. 13, 1982

[54] ELECTRONICALLY CONTROLLED IGNITION FOR INTERNAL COMBUSTION ENGINES

[75] Inventors: Toshikazu Ina, Okazaki; Hisasi Kawai, Toyohashi, both of Japan

[73] Assignee: Nippon Soken, Inc., Nishio, Japan

[21] Appl. No.: 97,661

[22] Filed: Nov. 27, 1979

[30] Foreign Application Priority Data

Dec. 7, 1978 [JP] Japan ..... 53-152336

[51] Int. Cl.[3] ..... F02P 5/04

[52] U.S. Cl. ..... 123/417; 123/414; 123/416

[58] Field of Search ..... 123/416, 417, 414

[56] References Cited

U.S. PATENT DOCUMENTS

| | | | |
|---|---|---|---|
| 3,927,648 | 12/1975 | Kawai et al. | 123/416 |
| 4,036,190 | 7/1977 | Bigliani et al. | 123/416 |
| 4,081,995 | 4/1978 | Griffith et al. | 123/416 |
| 4,162,667 | 7/1979 | Kawai et al. | 123/416 |
| 4,167,923 | 9/1979 | Iwase et al. | 123/416 |
| 4,168,682 | 9/1979 | Gartner et al. | 123/416 |
| 4,175,507 | 11/1979 | Kawai et al. | 123/416 |

*Primary Examiner*—P. S. Lall

*Attorney, Agent, or Firm*—Cushman, Darby & Cushman

[57] ABSTRACT

An electronically controlled ignition system for internal combustion engines. Reference position detecting means generates reference signals and angular position detecting means generates angular signals indicative of the angular positions of an engine at every predetermined angle of its rotation. Computing means responsive to engine operating condition parameters computers a proper ignition coil energization starting timing data and a proper ignition coil de-energizing timing data. An ignition coil control circuit comprising latch circuits, comparator circuits and counting means converts the ignition coil energization starting timing data and the ignition coil de-energization timing data into pulses having a corresponding pulse width with respect to the rotational angle of the engine to supply an ignition coil energization starting timing signal and an ignition coil de-energizing timing signal to said ignition coil. The computations of the energization starting timing and de-energization timing are initiated in response to the reference signal and the energization starting timing signal, respectively, so that the energization starting timing data is computed by using the de-energization timing data computed in the preceding computation cycle and that the ignition coil control circuit is simplified in circuit construction.

6 Claims, 18 Drawing Figures

ELECTRONICALLY CONTROLLED IGNITION FOR INTERNAL COMBUSTION ENGINES

BACKGROUND OF THE INVENTION

The invention relates to an electronically controlled ignition system for internal combustion engines (hereinafter referred to as ESA).

Known ignition systems for internal combustion engines are so designed that an ignition coil thereof generates a high-energy output in order to control exhaust emissions and improve fuel consumption. Consequently, there is a disadvantage that, where the ignition coil is energized for a period of time corresponding to fixed degrees of the crankshaft rotation, if the degrees of crankshaft rotation corresponding to the required energizing period for rendering the ignition coil saturated with stored energy are set to fit a high engine speed, the energizing period will be increased excessively at lower speeds and consequently the energization of the ignition coil after the saturation of the stored energy will cause generation of heat in the ignition coil and the ignition coil drive circuit. On the other hand, the setting of the degrees of crankshaft rotation to fit a low engine speed raises a problem such that the energizing period will be decreased excessively at higher speeds and consequently there will not be saturation of stored energy of the ignition coil causing insufficient ignition energy.

Another type of ignition systems is known in the art in which a proper ignition coil energization starting timing is computed by a main computing unit and the ignition coil energizing period is controlled according to the computed data. However, this type of known ignition system has a disadvantage of requiring a pair of comparators, one for determining the time to energize the ignition coil and the other for determining the time to deenergize the ignition coil, which causes a complicated circuit construction.

SUMMARY OF THE INVENTION

With a view to overcoming the foregoing deficiencies in the prior art, it is an object of the invention to provide an electronically controlled ignition system for internal combustion engines, which comprises angular position detecting means for generating an angular signal each time the engine rotates through a predetermined angle, computing means responsive to engine parameters for computing a proper ignition advance angle and a proper ignition coil energization starting timing, and an ignition coil control circuit responsive to the angular phases to control the ignition coil energization starting timing and the ignition advance angle in relation with the angular position of the engine, whereby the timing of supplying the two timing data, i.e., the ignition coil energization starting timing data and the ignition advance angle data, to the ignition coil control circuit from the computing means is controlled by using, for example, a reference position signal as a trigger signal for the computation of the ignition coil energization starting timing data and the ignition coil energization starting signal supplied from the ignition coil control circuit as a trigger signal for the computation of the ignition advance angle data, that is, both the ignition coil energization starting timing data and the ignition advance angle data can be controlled with high precision by the single ignition coil control circuit, thus making it possible to control the ignition coil charging period at an optimum time. Thus, with the simplified construction, the present invention eliminates the foregoing deficiencies, i.e., the generation of heat in the ignition coil and the ignition coil drive circuit due to excessive energization of the ignition coil on the one hand and the generation of insufficient ignition energy due to insufficient energization of the ignition coil on the other hand.

DESCRIPTION OF THE PREFERRED EMBODIMENT

The invention will now be described in greater detail with reference to the illustrated embodiments.

Figure 1:
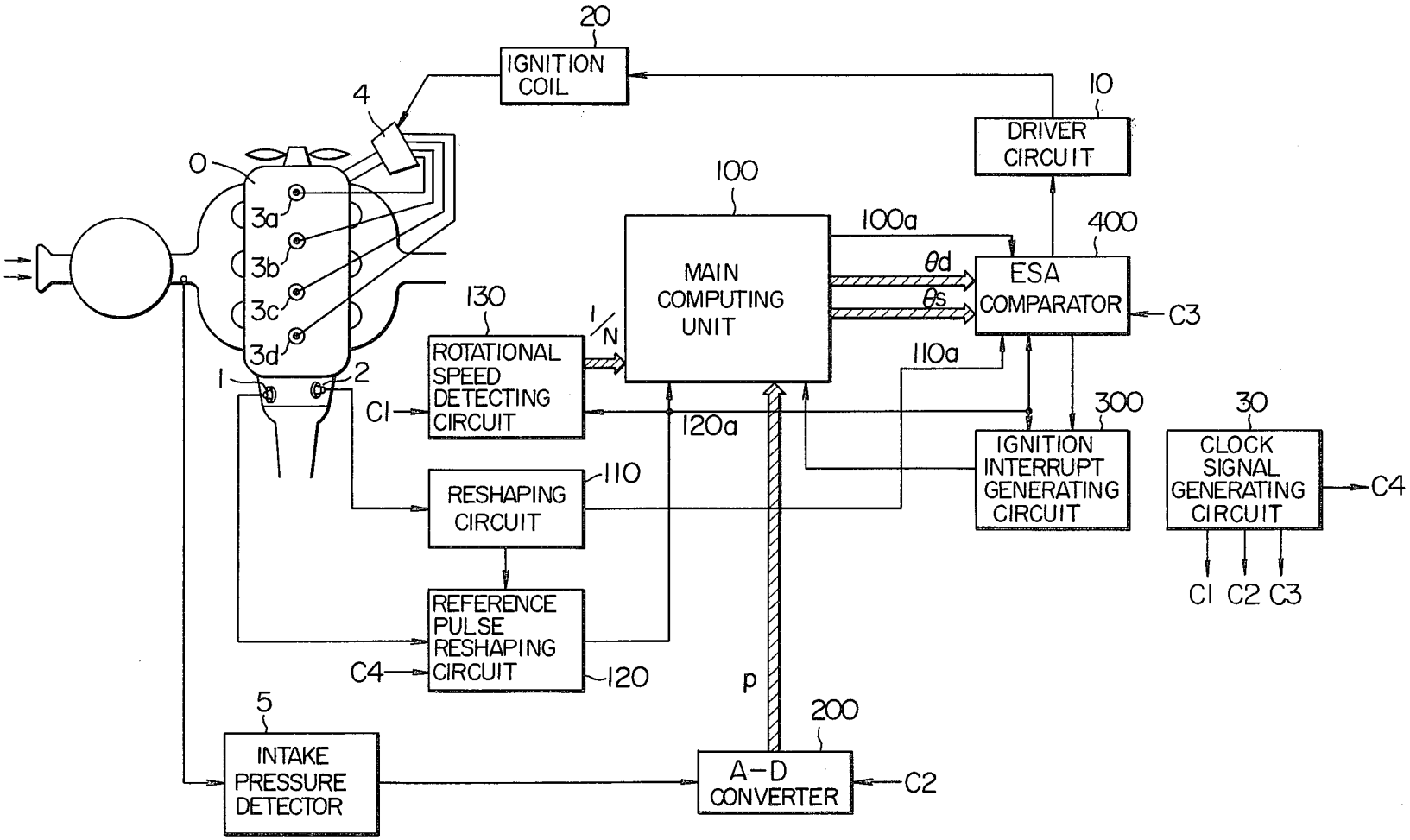
FIG. 1 is a schematic block diagram showing the overall construction of an embodiment of an ignition system according to the invention.

Referring to FIG. 1, there is illustrated a basic construction of the invention. In the Figure, numeral 0 designates an engine, 2 an angular position detector comprising a known type of electromagnetic pickup for detecting the rotational angle of the engine in terms of pulses generated by the teeth of a ring gear mounted on the crankshaft of the engine 0, and 1 a reference position detector comprising an electromagnetic pickup for detecting the position of an iron piece attached likewise to the ring gear at a position corresponding to a predetermined reference angular position to generate a reference position signal pulse at every crankshaft revolution. The reference position detector 1 and the angular position detector 2 form a rotational angle sensor for generating an angular pulse at every predetermined rotational angle of the engine 0. Numeral 5 designates an intake manifold pressure detector for generating an analog voltage proportional to the intake manifold pressure. This analog voltage is converted to a digital signal by an analog-to-digital converter or A-D converter 200, and the digital signal is applied to a main computing unit 100. The angular signal produced by the angular position detector 2 is applied to a reshaping circuit 110. The reference pulse produced by the reference position detector 1 is reshaped by a reference pulse reshaping circuit 120, and by the use of the angular signal which is the output of the reshaping circuit 110, the reference pulse reshaping circuit 120 generates a reference signal at every 180 degrees crankshaft rotation, which reference signal is applied to the main computing unit 100 and a rotational speed detecting circuit 130. The reference signal is also utilized as a trigger signal for an ESA comparator 400 and an ignition interrupt generating circuit 300 both of which will be explained later.

The rotational speed detecting circuit 130 for computing the engine rotational speed is designed to represent the period of the output signal from the reference pulse reshaping circuit 120 as the reciprocal of the engine speed per unit time in terms of the binary code and to apply it to the main computing unit 100. The rotational speed detecting circuit 130 operates in response to the clock signal $C_1$ of a fixed period supplied from a clock signal generating circuit 30 comprising a known crystal oscillator circuit. Further, the clock signal generating circuit 30 generates a plurality of other clock signals $C_2$, $C_3$ and $C_4$ of the respective fixed periods.

The main computing unit 100 supplied with the above-mentioned input signals is triggered by an output signal 120*a* from the reference pulse reshaping circuit 120. The main computing unit 100 receives the rotational speed data from the rotational speed detecting circuit 130 and the intake pressure data from the A-D converter 200 and performs the desired computation, namely, the computation of the desired ignition coil energization starting timing data $\theta_d$ by using an ignition advance angle data $\theta_s$ which will be explained later. The main computing unit 100 supplies the ignition coil energizing timing data $\theta_d$ in the binary code form to the ESA comparator 400. By the use of the angular signal 110*a* from the reshaping circuit 110 and the clock signal $C_3$ from the clock signal generating circuit 30. The ESA comparator 400 converts the ignition coil energization starting timing data $\theta_d$ from the main computing unit 100 to an angle measured from the reference signal 120*a* generated by the reference pulse reshaping circuit 120 and generates an ignition coil energization starting signal, which ignition coil energization starting signal is applied to an ignition coil driver circuit 10 and the ignition interrupt generating circuit 300. The ignition coil driver circuit 10 drives an ignition coil 20 which in turn supplies a high voltage through a high-voltage distributor 4 to spark plugs 3*a* to 3*d* mounted on the respective cylinders of the engine 0. The ignition interrupt generating circuit 300 receives the ignition coil energization starting signal as its trigger signal and generates and applies an ignition advance computation interrupt signal to the main computing unit 100. The main computing unit 100 is triggered by the output interrupt signal from the ignition interrupt generating circuit 300 and computes the ignition advance data $\theta_s$, which ignition advance data $\theta_s$ is applied in the binary code form to the ESA comparator 400. In addition, the main computing unit 100 supplies a discrimination signal 100*a* for discriminating the ignition coil energization starting timing data $\theta_d$ and the ignition advance data $\theta_s$ to the ESA comparator 400. The ESA comparator 400 converts the ignition advance data $\theta_s$ to an angle measured from the reference signal 120*a* in the similar manner as the conversion of the ignition coil energization starting timing data $\theta_d$ and supplies the ignition signal discriminated by the discrimination signal 100*a* to the ignition coil driver circuit 10. The ignition coil driver circuit 10 drives the ignition coil 20 to make it generate a high voltage. The high voltage is supplied to the spark plugs 3*a* to 3*d* through a high-voltage distributor 4. As described above, the ignition coil energization starting timing data $\theta_d$ is computed by using the computed value of the ignition advance data $\theta_s$ and this computation is performed repeatedly. For this purpose, the ignition advance data $\theta_s$ is stored in the storage circuits (latches) of the main computing unit 100 as will be described later.

In the present embodiment, the microcomputer TLCS-12A manufactured by Toshiba, or INTEL 8086, for example, is used as the main computing unit 100. Since the detailed construction and operation of these microcomputers are well known, they will not be described. The microcomputer 100 comprises a read-only memory (ROM) and the values of the engine speed and the intake manifold pressure are stored in the ROM so that the optimum ignition advance may be obtained in accordance with the respective values of the engine speed and the intake manifold pressure.

On the basis of the basic principle of operation and the basic construction described above, the construction and operation of each of the component parts of the ignition system of this invention will be described in detail.

Figure 2:
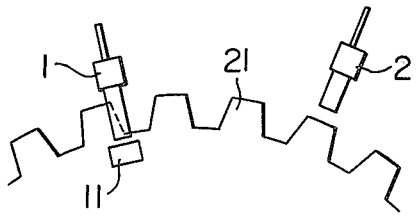
FIG. 2 is a schematic diagram showing the rotational angle detector and the reference position detector shown in FIG. 1.

FIG. 2 shows the constructions of the angular position detector 2 and the reference position detector 1 for detecting the rotational angle of the engine 0. In the Figure, numeral 21 designates a ring gear, and 11 an iron piece fixed to the ring gear at a position thereof corresponding to a reference position which is 180 degrees before the top dead center (BTDC) of the No. 1 cylinder. In this embodiment, the number of the teeth of the ring gear 21 is 115 and consequently the angular position detector 2 generates 115 pulses at every crankshaft revolution. The reference position detector 1 detects, once at every crankshaft revolution, the position of 180° BTDC for the No. 1 or No. 4 cylinder in the case of a four-cycle four-cylinder engine.

Figure 3:
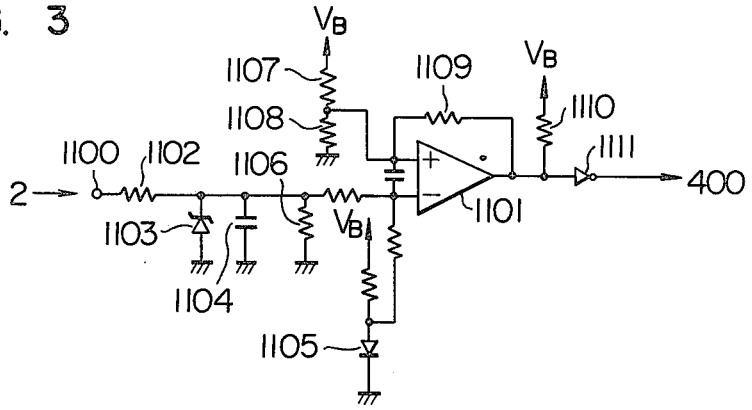
FIG. 3 is a circuit diagram showing in detail the construction of the angular pulse reshaping circuit shown in FIG. 1.

The signal detected by the angular position detector 2 is reshaped by the angular signal reshaping circuit 110. The construction of the reshaping circuit 110 is shown in FIG. 3. The angular signal applied to an input terminal 1100 is clamped suitably by a Zener diode 1103 with a integration time constant determined by resistors 1102 and 1106 and a capacitor 1104 and the clamped signal is applied to the inverting input terminal of a comparator 1101 (for example, Motorola MC 3302). On the other hand, the forward voltage of a diode 1105 is applied as a bias voltage to the inverting input of the comparator 1101 and a bias voltage of substantially the same value as that applied to the inverting input is applied to the non-inverting input of the comparator 1101 by voltage dividing resistors 1107 and 1108. Then, the pulsating voltage of the angular signal applied through the input terminal 1100 causes the comparator 1101 to produce a pulse signal at its output terminal which output pulse signal is in opposite phase to the input signal. Numeral 1109 designates a positive feedback resistor for making the rise and fall of the pulse sharper, and 1110 a load resistor. An inverter 1111 is connected to make the output signal in phase with the input signal.

Figure 4:
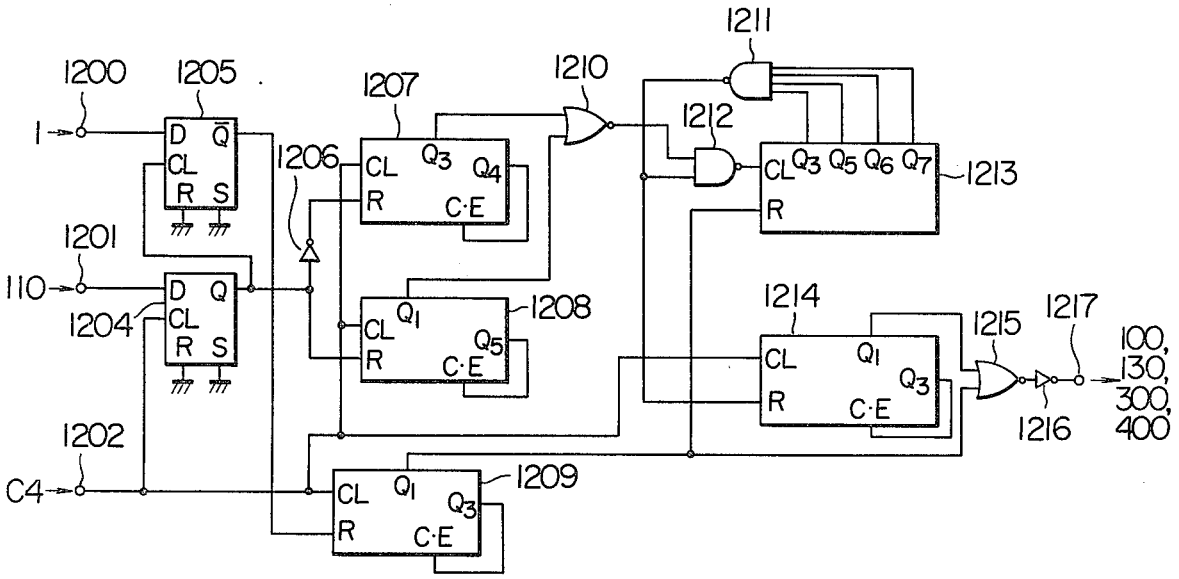
FIG. 4 is a circuit diagram showing in detail the construction of the reference pulse reshaping circuit shown in FIG. 1.
Figure 5:
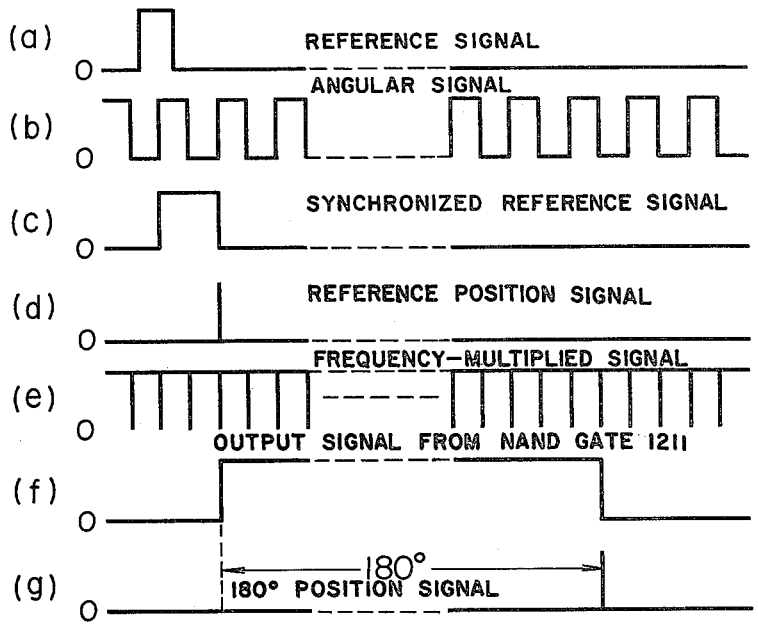
FIGS. 5 and 6 are signal waveform diagrams for explaining the operation of the circuit shown in FIG. 4.
Figure 6:
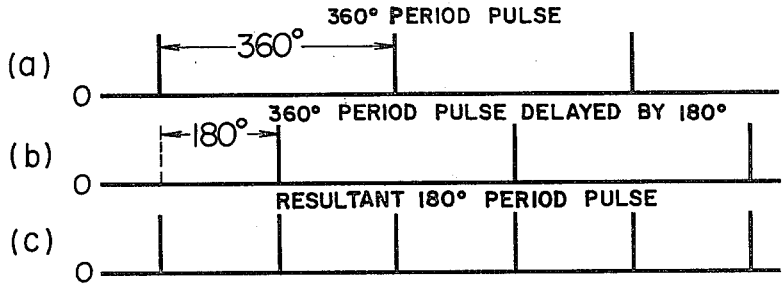

While the signal detected by the reference position detector 1 comprises a pulse generated once per one crankshaft revolution (360°), the ignition must be effected once at every 180° crankshaft revolution in the case of a four-cycle four-cylinder engine. Consequently, as reference position signals indicative of the reference position for measuring an ignition angle, it is necessary to generate an apparent reference signal additionally at a position which is displaced 180° from the basic detection position. This operation is performed by the reshaping circuit 120 whose circuit construction is shown in FIG. 4, and the signal waveforms at various points in the circuit are shown in FIGS. 5 and 6. In FIG. 4, the detected and reshaped signal from the reference position detector 1 is applied to an input terminal 1200. Since this waveform reshaping is performed with the same circuit construction as the circuit shown in FIG. 3, no detailed illustration and explanation of the circuit construction will be made. The output signal from the angular signal reshaping circuit 110 is applied to an input terminal 1201, and the clock signal $C_4$ having a sufficiently high frequency (e.g., 260 kHz) as compared with that of the angular signal is applied to an input terminal 1202. The angular signal applied to the input terminal 1201 is synchronized with the clock signal $C_4$ in a D-type flip-flop 1204, and it is then applied to the clock input of a D-type flip-flop 1205 so as to synchronize the reference signal applied to the input terminal 1200 with the angular signal. Consequently, as shown in (a), (b) and (c) of FIG. 5, the reference signal (a) applied to the input terminal 1200 is synchronized with the angular signal (b) and its waveform becomes as shown in (c) of FIG. 5. The synchronized reference signal waveform shown in (c) of FIG. 5 is applied to the reset input of a divider/counter 1209 (for example, RCA CD 4017) which in turn generates at its $Q_1$ output a narrow pulse occurring at the falling position of the synchronized signal (c) as shown in (d) of FIG. 5. This pulse signal is indicative of the basic reference position.

On the other hand, in order to generate an apparent reference signal at a position displaced by 180° from the basic reference position, the pulses generated by the ring gear teeth are counted from the basic reference position to detect a position displaced by 180°. In this case, since the number of the teeth of the ring gear 1 is 115 as mentioned previously, the number of teeth corresponding to 180° is 57.5 and this is not an integer. This shows that if the reference position signal shown in (d) of FIG. 5 is generated at the rising position of the angular signal (b), the apparent reference position signal must be generated at the falling position of the angular signal (b). Therefore, in the present embodiment, the frequency-multiplied signal shown in (e) of FIG. 5 is formed with an inverter 1206, dividers/counters 1207 and 1208, and a NOR gate 1210, whereby the 180° reference position signal is made to synchronize with the falling position of the angular signal (b). The inverted signal of the angular signal in (b) of FIG. 5 is applied to the reset input of the divider/counter 1207 and the signal shown in (b) of FIG. 5 is applied as such to the reset input of the divider/counter 1208. Consequently, the counter 1207 generates at its $Q_3$ output a narrow pulse synchronized with the rising position of the angular signal in (b) of FIG. 5 and the counter 1208 generates at its $Q_1$ output a pulse synchronized with the falling position of the angular signal (b). The two pulses are then applied to the NOR gate 1210 which in turn generates at its output the frequency-multiplied signal shown in (e) of FIG. 5. The frequency-multiplied signal pulses in (e) of FIG. 5 are counted by NAND gates 1212 and 1211 and a binary counter 1213 (for example, RCA CD 4040) until the 180° position is reached. While the count value corresponding to 180° in the present case is $57.5\times2=115$, it is so designed that the binary counter 1213 counts a pulse from the divider/counter 1207 immediately after the binary counter 1213 has been reset by the reference signal from the divider/counter 1209 and consequently the count value of the binary counter 1213 is preset at $115+1=116=2^6+2^5+2^4+2^2$. After the binary counter 1213 has been reset, when its count reaches "116", the output of the NAND gate 1211 changes from a high level to a low level and its waveform becomes as shown in (f) of FIG. 5. The output of the NAND gate 1211 is connected to an input of the NAND gate 1212 and the reset input of a divider/counter 1214, thereby causing the NAND gate 1212 to interrupt the supply of the clock signal to the clock input of the binary counter 1213 when the output of the NAND gate 1211 has changed to the low level and simultaneously the divider/counter 1214 to generate at its $Q_1$ output the 180° position signal shown in (g) of FIG. 5.

As a result, a NOR gate 1215 and an inverter 1216 perform the OR operation on the 360°-period pulse from the $Q_1$ output of the divider/counter 1209 shown in (a) of FIG. 6 and the 360°-period pulse from the $Q_1$ output of the divider/counter 1214 which is delayed by 180° from the signal in (a) of FIG. 6 as shown in (b) of FIG. 6, and the resultant 180°-period pulse shown in (c) of FIG. 6 is generated at an output terminal 1217 of the circuit.

Figure 7:
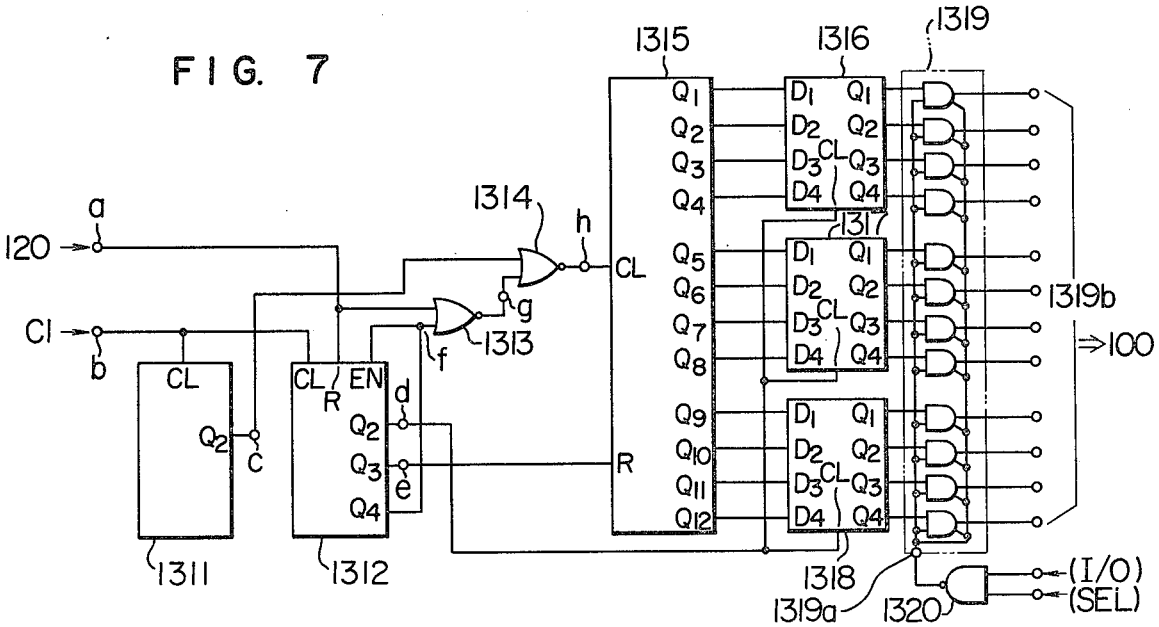
FIG. 7 is a circuit diagram showing in detail the construction of the rotational speed detecting circuit shown in FIG. 1.
Figure 8:
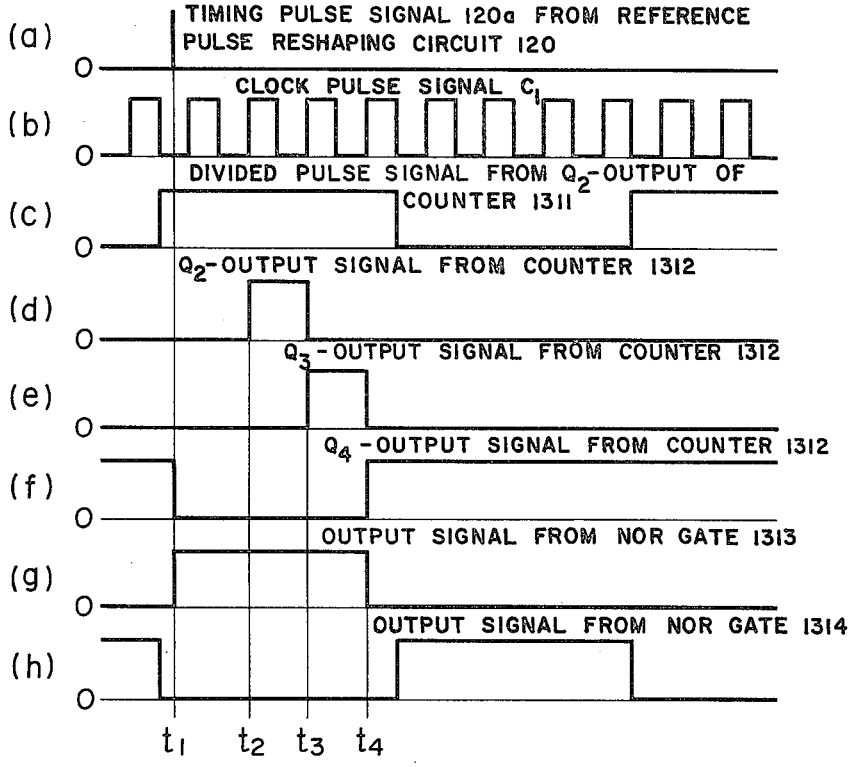
FIG. 8 is a signal waveform diagram for explaining the operation of the circuit shown in FIG. 7.

Next, the rotational speed detecting circuit 130 will be described. FIG. 7 shows its circuit construction and FIG. 8 shows the signal waveforms at various points in the circuit. In FIG. 7, a binary counter 1311 counts and frequency-divides the clock pulse signal $C_1$ applied to its clock input terminal CL. The counter 1311 may be, for example, RCA CD 4024. The counter 1311 frequency-divides the clock pulse signal $C_1$ of about 128 KHz shown in (b) of FIG. 8 and outputs the divided pulse signal of about 32 kHz shown in (c) of FIG. 8 at its output terminal $Q_2$.

Basically a divider/counter 1312 counts the clock pulse signal $C_1$ applied to its clock input terminal CL. The divider/counter 1312 is constructed to stop its counting operation when the output signal at one of its output terminals $Q_2$ to $Q_4$ takes "1" level and a "1" level signal is applied to its counting operation stopping terminal EN.

In the divider/counter 1312 of the present embodiment, however, the output terminal $Q_4$ is connected to the stop terminal EN, so that, when the output signal at the output terminal $Q_4$ takes "1" level, a "1" level signal is applied to the stop terminal EN and the counting operation is stopped. In this state, when the timing pulse signal shown in (a) of FIG. 8 is applied to the reset terminal R from the reference pulse reshaping circuit 120, the counter 1312 is reset and the output signal at its output terminal $Q_4$ takes "0" level as shown in (f) of FIG. 8. When the signal applied to the reset terminal R becomes "0" level, the counter 1312 starts its counting operation and the sequential pulse signals shown in (d) and (e) of FIG. 8 are generated respectively from the $Q_2$ and $Q_3$ output terminals. Thereafter, when the output signal at the output terminal $Q_4$ becomes "1" level, the counter 1312 again stops its counting operation.

The $Q_2$ output of the counter 1311, the $Q_4$ output of the counter 1312 and the output signal of the reference pulse reshaping circuit 120 are applied to the clock input terminal CL of a 12-bit counter 1315 through NOR gates 1313 and 1314, respectively, and the $Q_3$ output of the counter 1312 is applied to the reset terminal R of the counter 1315.

More specifically, the NOR gate 1313 performs the NOR operation on the output signal of the reference pulse reshaping circuit 120 shown in (a) of FIG. 8 and the $Q_4$ output signal of the counter 1312 shown in (f) of FIG. 4 to generate a pulse signal shown in (g) of FIG. 8, and the NOR gate 1314 performs the NOR operation on the output signal of the NOR gate 1313 and the output signal of the counter 1311 shown in (c) of FIG. 8 to output a pulse signal shown in (h) of FIG. 8 and supplies it to the counter 1315.

At the time $t_1$ when the timing pulse signal shown in (a) of FIG. 8 takes "0" level and the output signal of the NOR gate 1313 shown in (g) of FIG. 8 takes "1" level, the counter 1315 stops its counting operation. Thereafter, the outputs at the output terminals $Q_1$ to $Q_{12}$ are stored temporarily in shift registers 1316 to 1318 (for example, RCA CD 4035) in response to the rise of the $Q_2$ output signal of the counter 1312 at the time $t_2$. Then, when the $Q_3$ output signal of the counter 1312 takes "1" level at the time $t_3$, the counter 1315 is reset. The counter 1315 again starts its counting operation when the $Q_4$ output signal of the counter 1312 takes "1" level at the time $t_4$.

This operation of the counter 1315 is performed repeatedly in response to the timing pulse signals generated by the reference pulse reshaping circuit 120 in synchronism with the engine rotation. Consequently, a binary coded signal proportional to the reciprocal 1/N of the engine rotational speed N is generated at the output terminals $Q_1$ to $Q_4$ of the shift registers 1316 to 1318, respectively.

A 3-state buffer 1319 shown in FIG. 7 has a construction such that, so long as a "1" level signal is applied to its control terminal 1319*a*, its output terminal group 1319*b* presents a high impedance and the appearance of output signals is inhibited there. The output terminal group 1319*b* is connected through a bus line to the main computing unit, namely, the microcomputer 100.

The output signal of a NAND gate 1320 is applied to the control terminal 1319*a*. Here, the NAND gate 1320 receives an input/output control signal (hereinafter referred to as an I/O signal) and a device select signal (hereinafter referred to as an SEL signal) from the device control unit (hereinafter referred to simply as a DCU) incorporated in the microcomputer 100. When the output of the NAND gate 1320 takes "0" level, the output signals are no longer inhibited at the output terminal group 1319*b* and the binary coded signal proportional to 1/N is applied from the shift registers 1316 to 1318 to the microcomputer 100.

Figure 9:
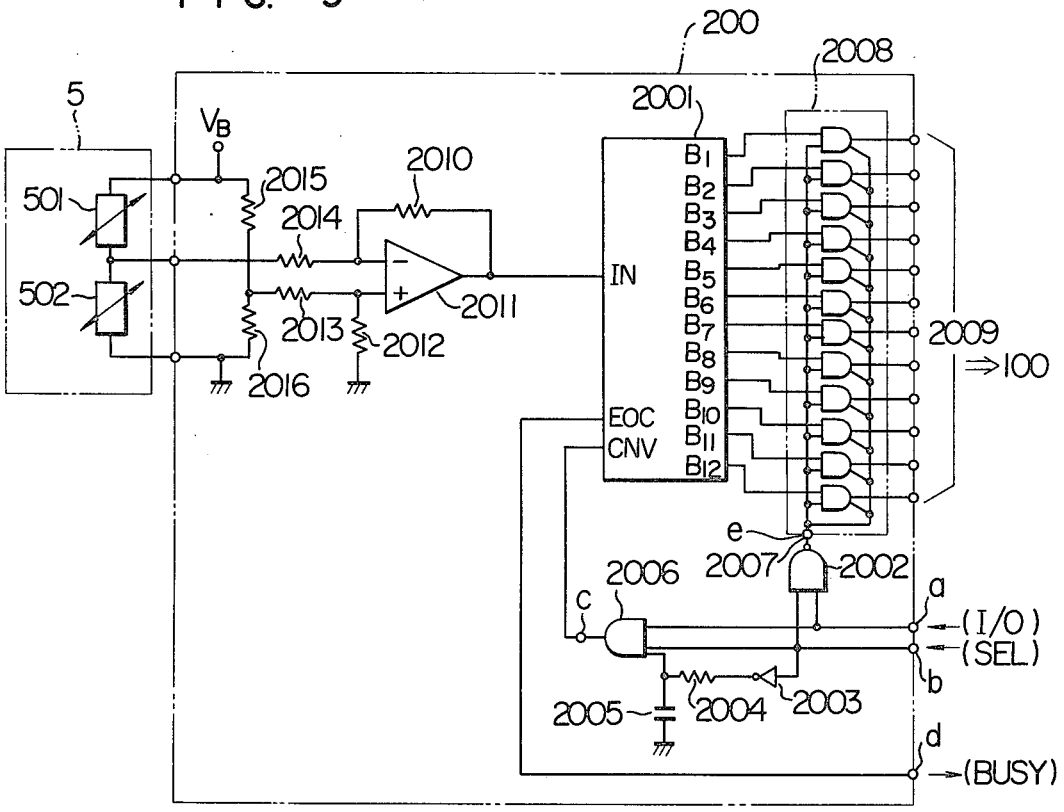
FIG. 9 is a circuit diagram showing in detail the construction of the intake pressure detecting circuit and the A-D converter circuit shown in FIG. 1.

Next, the intake manifold pressure detector 5 and the A-D converter circuit 200 will be described with reference to FIG. 9. In the present embodiment, the intake manifold pressure detector 5 is of the semiconductor type employing a silicone diaphragm and its electric resistance value varies with applied pressure based on the piezoelectric resistance effect.

The A-D converter circuit 200 will now be described. Resistors 2015 and 2016 form, along with resistance elements 501 and 502 of the intake pressure detector 5, a bridge circuit in which a dc bias $V_B$ is applied to the junction of the resistor 2015 and the resistance element 501, and the junction point of the resistor 2016 and the resistance element 502 is grounded. The resistance values of the resistance elements 501 and 502 of the intake manifold pressure detector 5 vary in a complementary mode with the value of the intake manifold pressure. The junction of the resistance elements 501 and 502 and the junction of the resistors 2015 and 2016 are respectively connected through input resistors 2014 and 2013 to an operational amplifier (hereinafter referred to as an OP amplifier) 2011. A ground resistor 2012 and a negative feedback resistor 2010 are connected to the OP amplifier 2011 and the OP amplifier 2011 operates as a differential amplifier. The output voltage of the OP amplifier 2011 is proportional to the intake pressure in the intake manifold.

The output voltage of the OP amplifier 2011 is applied as an input to a sequential comparison type A-D converter 2001 (for example, BURR-BROWN ADC 80AG-12).

Figure 10:
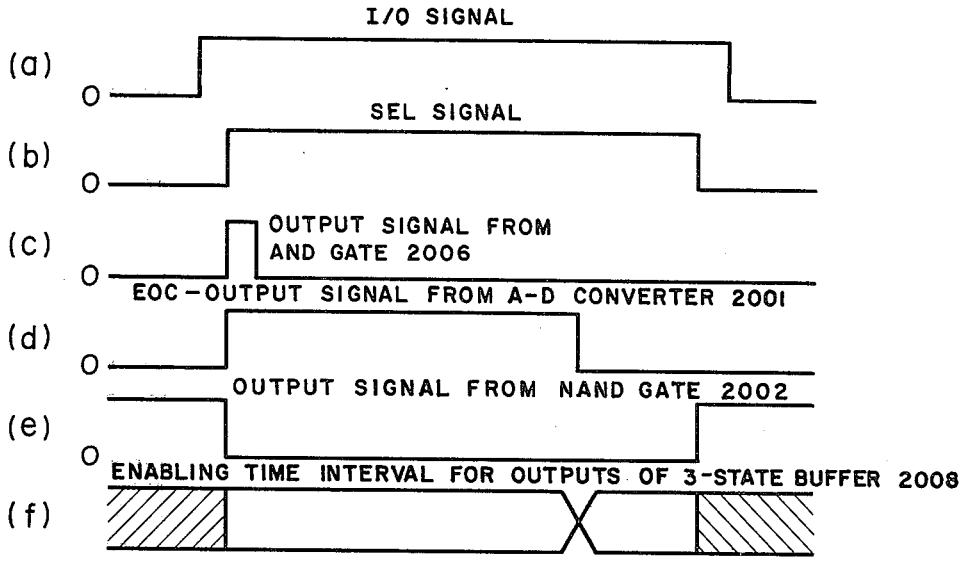
FIG. 10 is a signal waveform diagram for explaining the operation of the circuits shown in FIG. 9.

The I/O signal shown in (a) of FIG. 10 and the SEL signal shown in (b) of FIG. 10 are respectively applied from the DCU of the microcomputer 100 to a NAND gate 2002 and an AND gate 2006.

A delay circuit is formed by an inverter 2003, a resistor 2004 and a capacitor 2005. The SEL signal is applied to the AND gate 2006 through the delay circuit.

Thus the AND gate 2006 generates a pulse signal shown in (c) of FIG. 10 whose pulse width is in the order of 100 nanoseconds. This pulse signal is applied to the A-D conversion command input terminal CNV of the sequential comparison type A-D converter 2001.

The sequential comparison type A-D converter 2001 initiates its conversion operation in response to the fall of the pulse signal applied to the A-D conversion command input terminal CNV and simultaneously the output signal of the end-of-conversion terminal EOC takes "1" level as shown in (d) of FIG. 10.

The end-of-conversion terminal EOC is connected to the busy terminal BUSY of the device control unit DCU in the microcomputer 100. The completion of the command for reading the intake pressure signal into the microcomputer 100 is held in a waiting state until the output signal from the end-of-conversion terminal EOC falls to "0" level and during this time interval both the I/O and SEL signals are maintained at "1" level, rendering the output signal of the NAND gate 2002, namely, the signal applied to a control terminal 2007 of a 3-state buffer 2008 to stay at "0" level as shown in (e) of FIG. 10.

Thus, the sequential comparison type A-D converter 2001 performs its conversion operation and delivers a digitized binary data signal from its output terminals $B_1$ to $B_{12}$ while the output signal from the terminal EOC stays at "1" level.

The 3-state buffer 2008 is of the same type with that used in the rotational speed detecting circuit 130, so that, when a "0" level signal shown in (e) of FIG. 10 is applied to the control terminal 2007, the binary data signal is permitted to go out from the output terminal group 2009 to the microcomputer 100 via a bus line during the unhatched time interval in (f) of FIG. 10.

When the A-D conversion operation has been completed, the value of the signal on the bus line leading to the microcomputer 100 becomes fixed and at the same time the output signal at the end-of-conversion terminal EOC shown in (d) of FIG. 10 becomes "0" level. Then, the waiting state for the read command on the microcomputer 100, described previously, is released and the intake pressure data signal on the bus line is read into the microcomputer 100. When the read operation is completed, the microcomputer 100 changes the I/O and SEL signals to "0" level thereby to cause a "1" level signal to be applied to the control terminal 2007 of the 3-state buffer 2008 as shown in (e) of FIG. 10 and the output terminal group 2009 of the 3-state buffer 2008 to present a high impedance, thus completing the intake pressure data read operation.

The main computing unit 100 will be described hereunder. In the present embodiment, the main computing unit 100 comprises a microcomputer (for example, TOSHIBA TLCS-12A or INTEL 8086) designed to perform various computing operations in the time-sharing manner by the use of software, thereby attaining the desired reduction in size and simplification of the construction. The construction and operation of a microcomputer are well known in the art and their explanations will be omitted. Thus, only the computing operations performed in the present embodiment will be described.

Figure 11A:
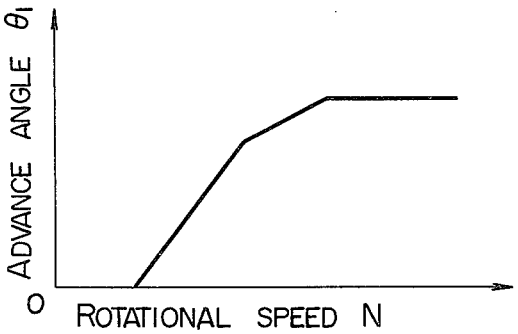
FIGS. 11*a* and 11*b* are graphs showing the ignition advance characteristics programmed in the main computing unit shown in FIG. 1.
Figure 11B:
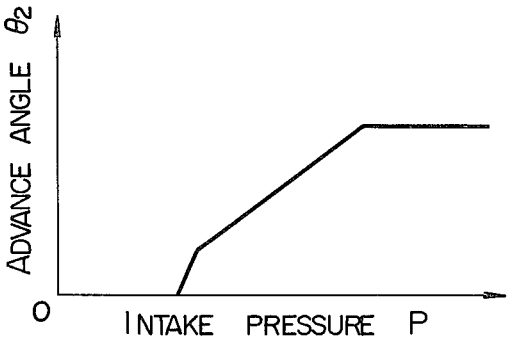

The ESA computation involves the following processings. The ESA function makes it possible that the characteristics of the ignition advance versus separate parameters as shown in FIGS. 11*a* and 11*b* are combined and used to control the application of a high voltage to each of the spark plugs at each proper ignition timing and further to control the ignition coil energization starting timing thereby to maintain the ignition coil energizing period at a constant value. Then, in the embodiment, the ignition advance characteristics shown in FIGS. 11*a* and 11*b* are beforehand programmed into the memory of the microcomputer 100, and advance angles $\theta_1$ and $\theta_2$ are computed in accordance with the read-in data or the rotational speed N and intake vacuum P which are supplied to the microcomputer 100 from outside and both advance angles are added together to obtain the desired ignition angle data. In this case, the reference position for computing the desired ignition angle is taken at 180° BTDC for the respective cylinders as mentioned previously. Accordingly, if it is desired to effect the ignition at the position of the advance angle of 10°, for example, it is necessary to program advance characteristics so as to obtain the angle data $\theta_s$ of $180°-10°=170°$. The computation of this ignition advance angle is initiated by the signal supplied from the interrupt generating circuit 300.

The computation of the ignition coil energization starting timing is initiated in response to the signal from the reference pulse reshaping circuit 120. In the computation an ignition coil energizing period $D_t$ is converted into the representation in terms of an angle. This ignition coil energizing angle is subtracted from the ignition angle data, which has been computed previously and stored in the memory, to obtain the desired ignition coil energization starting timing data $\theta_d$. For instance, with the ignition coil energizing period $D_t$ selected to be 3.9 ms the ignition coil energizing angle $D_{74}$ becomes 56° when the engine speed is 2400 RPM, and if the ignition angle data is 170° as in the previously mentioned example, the ignition coil energization starting timing data $\theta_d$ will be given by $170°-56°=114°$.

In performing the above-mentioned processing, with respect to the ignition advance versus engine speed characteristic, the rotational speed N is obtained by computing the reciprocal of the output 1/N of the rotational speed detecting circuit 130 and this rotational speed N is applied to the engine speed advance characteristic (FIG. 11*a*), which has been preliminarily programmed and stored in the memory to obtain the desired advance angle $\theta_1$ for the rotational speed N. Next, with respect to the vacuum advance characteristic, the intake pressure data output P is obtained through the intake manifold pressure detecting circuit 5 and the A-D converter 200 and this output P is applied to the vacuum advance characteristic (FIG. 11*b*), which has been preliminarily programmed and stored in the memory to obtain the desired vacuum advance angle $\theta_2$ for the intake pressure P. Next, the engine speed advance angle $\theta_1$ and the vacuum advance angle $\theta_2$ are added together and then $\theta_s=180°-(\theta_1+\theta_2)$ is computed to obtain the desired ignition angle data $\theta_s$.

The ignition coil energizing angle $D_\theta$is obtained from the ignition coil energizing period $D_t$ and the output 1/N of the rotational speed detecting circuit 130 as follows:

$$D_\theta=K\times D_t\div 1/N \quad (1)$$

where K is a proportional constant.

Next, since the ignition coil energization starting timing $\theta_d$ should precede the ignition angle data $\theta_s$ by the ignition coil energizing angle $D_\theta$, it can be obtained by computing $\theta_d=\theta_s-D_\theta$.

Finally, the ignition coil energization starting timing data $\theta_d$ and the ignition angle data $\theta_s$, which have been obtained by the above-mentioned computing operations of the main computing unit 100 in the binary code form, are applied to the ESA comparator 400 so that the data $\theta_d$ and $\theta_s$ may be subjected to the counting operations of the ESA comparator 400 thereby to determine the desired ignition coil energization starting position and ignition position measured from the reference position which is selected at 180° BTDC of the No. 1 or No. 4 cylinder.

Further, to make the ignition coil energizing period $D_t$ be inversely proportional to the engine rotational speed within a certain range of the engine rotational speeds, the following computation is performed by using a required ignition coil energizing period $D_{ot}$ and the output 1/N of the rotational speed detecting circuit 130:

$$D_t=K_1\times D_{ot}\times 1/N \quad (2)$$

where $K_1$ is a proportional constant and $D_{ot}$ is taken as 3.9 ms. Then, by substituting the resultant value of the ignition coil energizing period $D_t$ for the $D_t$ in the equation (1), it is possible to make the ignition coil energizing period $D_t$ inversely proportional to the engine rotational speed within the certain range of the engine rotational speeds.

Thus, this embodiment provides featured control in which the ignition coil energization starting timing data $\theta_d$ and the ignition angle data $\theta_s$ are alternately applied to the ESA comparator 400 and it is possible to count these two data by using the single ESA comparator 400.

The ESA comparator 400 will be described later in connection with the ignition interrupt generating circuit 300.

The computing operations required for raising the precision of counting the ignition coil energization starting timing data $\theta_d$ and the ignition angle data $\theta_s$ will now be described. Since the minimum unit of the angular signals serving as clock pulses in the angle counting is $360°/115 \cong 3.13°$, it is impossible to count any fractional units less than 3.13°. However, a special processing is effected to deal with a finer angle value. In other words, the following featured computing operations are conducted.

Figure 12:
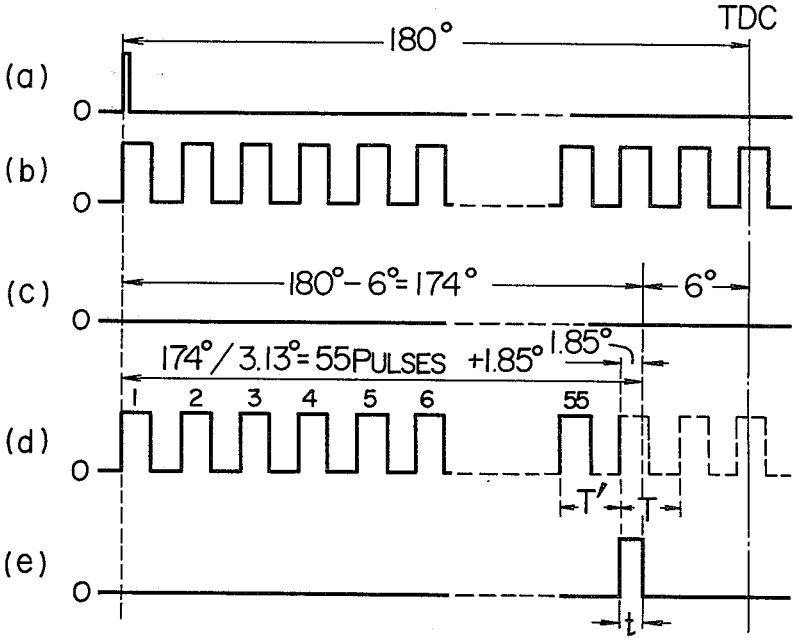
FIG. 12 is a signal waveform diagram for explaining the operation of the ignition timing control by the main computing unit shown in FIG. 1.

FIG. 12 shows, by way of example, a time chart for setting the ignition timing at 6 degrees BTDC. FIG. 12 (*a*) shows the reference signal 120*a* at the position of 180 degrees BTDC. FIGS. 12 (*b*) and (*c*) show the angular signals and the ignition timing, respectively. The position at 6 degrees BTDC can be detected by counting $180° - 6° = 174°$ from the reference signal position. FIG. 12 (*d*) shows that, after the counting of the angular signals up to $174°/3.13° = 55$ pulses, there is left a residual angle of 1.85°. Then, this residual angle is approximated by a proportional computation in terms of time. More specifically, as shown in FIG. 12 (*e*), t corresponds to the angle of 1.85°, which can be approximated by the following equation:

$$t = T \times (1.85/3.13) \quad (3)$$

where T is the period of the angular signal including the time t. However, as will be seen from FIG. 12, the value of T can be detected only after the desired ignition timing has passed, and hence the computation of the equation (3) is theoretically impossible. Therefore, the period of the preceding 55th pulse, namely, the angular signal period T′ is used instead of T as shown below:

$$t = T' \times (1.85/3.13) \quad (4)$$

The foregoing principle is based on the assumption that the resolution of the advance angle data generated from the computing circuit is infinite. However, practically the resolution of the advance angle data has a finite value determined by the number of bits used, with the result that the residual angle of 1.85° shown in FIG. 12 (*d*) assumes discrete values and also the angle t assumes discrete values. The minimum unit in the representation of t is dependent on the number of lower order bits in the binary representation of the advance angle data which are chosen to represent one period T′ of the angular signal. For example, if the lower three bits in the binary representation of the advance angle data are chosen to correspond to the magnitude of T′, since $2^3 = 8$, the minimum unit will be given by $3.13°/8 = 0.39°$. In order to set the ignition timing at 6 degrees BTDC, it is only necessary to represent the advance angle data with a binary number given by $174°/0.39° \approx 446 =$ "110111110". In this 9-bit binary number, the higher order 6 bits of "110111" = 55 are used as the main data, which are counted in terms of angular signals using 3.13° as a unit, and the lower order 3 bits of "110" = 6 are used as the subdata, which are used to effect proportional computation corresponding to the equation (4). Then, since 3.13° corresponds to $2^3 = 8$ and 1.85° corresponds to "110" = 6, the value of t is obtained by the computation using the equation $t = T' \times 6/8$, and the value of t is added to the result obtained by the conting of the main data, thereby obtaining the desired ignition timing.

The ignition coil energization starting timing data can be obtained by a similar method.

Figure 14A:
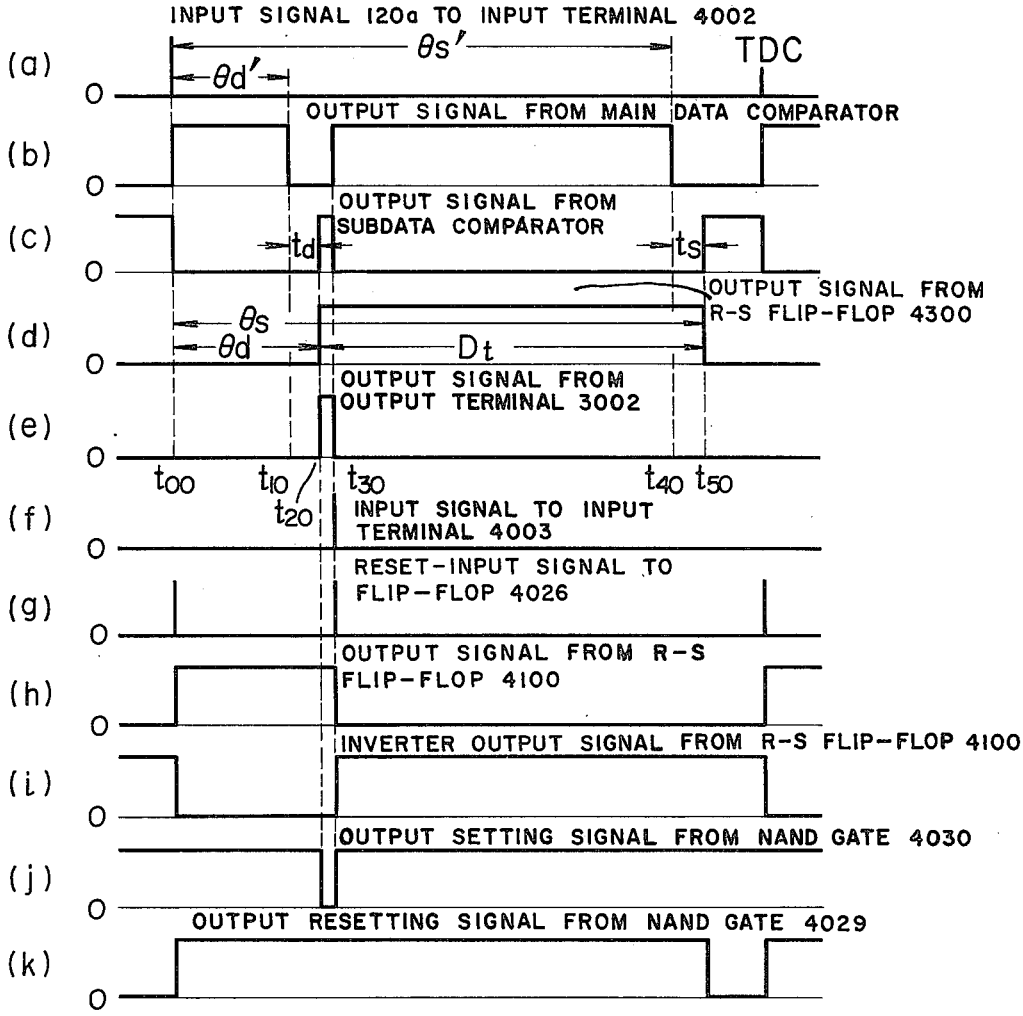
FIG. 14*a* is a signal waveform diagram for explaining the operation of the ESA comparator shown in FIG. 13.
Figure 13:
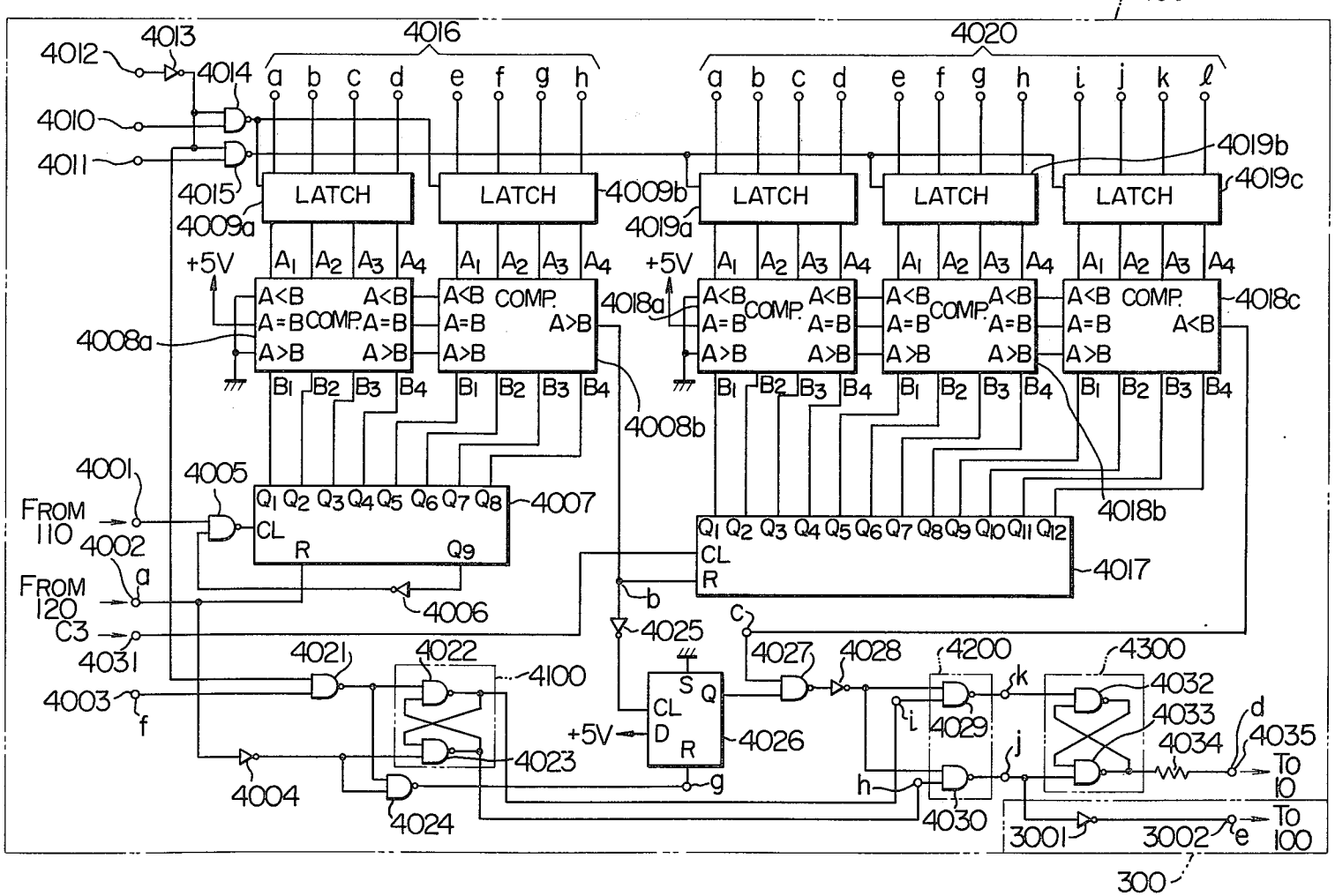
FIG. 13 is a circuit diagram showing in detail the construction of the ESA comparator shown in FIG. 1.

Next, the circuit constructions of the ESA comparator 400 and the ignition interrupt generating circuit 300 shown in FIG. 13 will be described. In FIG. 13 the output signal 120*a* of the reference pulse reshaping circuit 120 is applied to an input terminal 4002, the angular signal from the reshaping circuit 110 to an input terminal 4001, and the constant period clock signal $C_3$ (520 KHz) to an input terminal 4031. Numerals 4009*a* and 4009*b* designate latch circuits, and 4016 a to h input terminals of the latch circuits 4009*a* and 4009*b* through which the main data of the advance angle data computed by the main computing unit 100 are applied. The signals from the DCU of the main computing unit 100 are applied to input terminals 4010, 4011 and 4012. Namely, the input terminal 4010 receives the main data latching signal and the input terminal 4011 receives the subdata latching signal. The signal applied to the input terminal 4012 is inverted through an inverter 4013. A NAND gate 4014 performs a NAND operation on the inverted signal and the signal from the input terminal 4010 to deliver a resultant signal as a latch signal for the main data. A NAND gate 4015 performs a NAND operation on the output signal of the inverter 4013 and the signal from the input terminal 4011, and the resultant signal is used as a latch signal for the subdata. The main data are applied to the data input terminals 4016 a to h of the latch circuits 4009*a* and 4009*b* (for example, RCA CD 4042) and are stored in the latch circuits in response to the output latch signal from the NAND gate 4014 and the stored main data are delivered to the outputs terminals. The output signals of the latch circuits 4009*a* and 4009*b* are applied to the input terminals of comparators 4008*a* and 4008*b* (for example, RCA CD 4063). The inputs 4016*a* to 4016*d* of the latch circuit 4009*a* are respectively led to inputs $A_1$, $A_2$, $A_3$ and $A_4$ of the comparator 4008*a* and the inputs 4016*e* to 4016*h* of the latch circuit 4009*b* are respectively led to inputs $A_1$, $A_2$, $A_3$ and $A_4$ of the comparator 4008*b*. A main data comparator is constituted by a binary counter 4007 (for example, RCA CD 4040) and the comparators 4008*a* and 4008*b*, wherein the angular signals are counted to obtain angles $\theta'_d$ and $\theta'_s$ [shown in (b) of FIG. 14*a*] corresponding to the main data of the ignition coil energization starting timing data $\theta_d$ and the ignition angle data $\theta_s$, respectively. The waveform in (a) of FIG. 14*a* represents the output of the reference pulse reshaping circuit 120, namely, the reference signal 120*a*, and it is applied as a trigger signal to the input terminal 4002. On the other hand, the subdata obtained by the time proportioning computation shown by the equation (3) are applied to input terminals 4020*a* to 4020*l* of latch circuits 4019*a*, 4019*b* and 4019*c*. The latch circuits 4019*a*, 4019*b* and 4019*c* store the subdata in response to the signal supplied from the NAND gate 4015 and deliver the stored subdata to their output terminals. The output signals from the latch circuits 4019*a*, 4019*b* and 4019*c* are respectively applied to comparators 4018*a*, 4018*b* and 4018*c*. The input terminals 4020*a* to 4020*d* of the latch circuit 4019*a* are respectively led to inputs $A_1$, $A_2$, $A_3$ and $A_4$ of the comparator 4018*a*, the input terminals 4020*e* to 4020*h* of the latch circuit 4019*b* to inputs $A_1$, $A_2$, $A_3$ and $A_4$ of the comparator 4018*b*, and the input terminals 4020*i* to 4020*l* of the latch circuit 4019*c* to inputs $A_1$, $A_2$, $A_3$ and $A_4$ of the comparator 4018*c*. A binary counter 4017 and the comparators 4018*a*, 4018*b* and 4018*c* constitute a subdata comparator which produces the output signal waveforms shown in (c) of FIG. 14*a*.

The signals representing the angles $\theta'_d$ and $\theta'_s$, which correspond to the main data, act as reset signals for the subdata comparator, and the time intervals between the respective falling positions of the waveforms showing the angles $\theta'_d$ and $\theta'_s$ and the corresponding rising positions of the waveforms of the subdata comparator output signals correspond to $t_d$ and $t_s$, respectively.

Next, the relation between the timing of the above-described basic operation of the comparator 400 and the operation of the main computing unit 100 will be described. The output signal 120*a* of the reference pulse reshaping circuit 120 is applied to the input terminal 4002 of the ESA comparator 400 from which the signal 120*a* is sent to the reset terminal of the binary counter 4007 and an inverter 4004. When the binary counter 4007 is reset, the comparator for the main data $\theta'_d$ starts its counting operation. An inverter 4006 and a NAND gate 4005 are provided to prevent the occurrence of overflow in the counting operation of the binary counter 4007. The output signal of the inverter 4004 is applied to a NAND gate 4024 and a NAND gate 4023 of an R-S flip-flop 4100. The output signal of the NAND gate 4024 is applied to the reset terminal of a D-type flip-flop 4026 (for example, RCA CD 4013). The output signal of the NAND gate 4023 is applied to a NAND gate 4030 and the output signal of the other NAND gate 4022 of the R-S flip-flop 4100 is applied to a NAND gate 4029. The NAND gates 4029 and 4030 constitute a date selector 4200, and the output signal of an inverter 4028, which inverts the output signal of a NAND gate 4027, is applied as the other input signal to the NAND gates 4029 and 4030. The output signal of the NAND gate 4029 is applied to the reset terminal of an R-S flip-flop 4300 comprising NAND gates 4032 and 4033, and the output signal of the NAND gate 4030 is applied to the set terminal of the slip-flop 4300 and an inverter 3001. The output of the NAND gate 4033 is delivered to an output terminal 4035 via a resistor 4034, and the output signal of the inverter 3001 is delivered to an output terminal 3002. The output signal from the output terminal 3002 has a pulsed waveform shown in (e) of FIG. 14*a* and acts as an interruption signal for initiating the computation of $\theta_s$ in the main computing unit 100. The signal from the DCU in the main computing unit 100 is applied to an input terminal 4003. As previously described, the signal applied to the input terminal 4012 from the DCU in the main computing unit 100 is inverted by the inverter 4013. A NAND gate 4021 performs a NAND operation on the inverted signal and the signal applied to the input terminal 4003, and the output signal of the NAND gate 4021 is applied to an input terminal of the NAND gate 4022 of the R-S flip-flop 4100.

When the output signal 120*a* [shown in (a) of FIG. 14*a*] of the reference pulse reshaping circuit 120 is applied to the main computing unit 100, the main computing unit 100 computes the desired ignition coil energization starting timing data $\theta_d$ by using the ignition angle data $\theta_s$, which has previously been computed and stored in the memory, and the resultant data are supplied to the main data and subdata comparators in the comparator 400. More specifically, the binary counter 4007 is reset by the output signal 120*a* from the reference pulse reshaping circuit 120 occurring at the time $t_{00}$ to initiate the counting of the main data $\theta'_d$ in terms of the angular signals 110*a*. At the same time the D-type flip-flop 4026 is reset by the occurrence of the output signal 120*a* [shown in (g) of FIG. 14*a* is the signal waveform of the reset signal applied to the reset terminal of the flip-flop 4026]. Here, of the outputs of the data selector 4200 [the output signal waveforms of the NAND gates 4030 and 4029 of the data selector 4200 are respectively shown in (j) and (k) of FIG. 14*a*], the output terminal of the NAND gate 4030 is put in the ON state by the output signals from the R-S flip-flop 4100. When the required conditions for the main data comparator is met at the time $t_{10}$, the reset state of the binary counter 4017 of the subdata comparator is released by the output signals of the comparator 4008*b*, and the binary counter 4017 starts the counting of the subdata in terms of the clock signal $C_3$. When the required comparison condition is met at the time $t_{20}$ after the lapse of the time $t_d$, the level of the output signal of the subdata comparator rises and the output signal of the comparator 4018*c* sets the R-S flip-flop 4300 [as shown in (j) of FIG. 14*a*] through the NAND gate 4030 of the data selector 4200 which is in the ON state [as shown in (h) of FIG. 14*a*] and the level of the output signal at the output terminal 4035 rises [as shown in (d) of FIG. 14*a*]. At the same time, the level of the output signal at the output terminal 3002 of the ignition interrupt generating circuit 300 rises and the output signal is sent to the main computing unit 100 to cause the main computing unit 100 to execute the computation of the desired ignition angle data $\theta_s$, and the resultant ignition angle data $\theta_s$ obtained by the conputation is set in the ESA comparator 400. At the time $t_{30}$, a signal or switching the data selector 4200 [shown in (f) of FIG. 14*a*] is sent to the input terminal 4003 from the DCU in the main computing unit 100. The signal supplied to the input terminal 4003 is applied through the NAND gate 4021 and the R-S flip-flop 4100 to the data selector 4200 and turns the NAND gates 4030 and 4029 of the data selector 4200 off and on, respectively. When the ignition angle data $\theta_s$ is set in the ESA comparator 400, the level of the output signal of the main data comparator rises and the subdata comparator is reset and the level of the output signal of the subdata comparator falls. The main data comparator is continuing its counting operation from the time $t_{00}$, and at the time $t_{40}$ the required condition for the comparison with the main data $\theta'_s$ is satisfied and the level of the output signal of the main data comparator falls, so that the reset state of the binary counter 4017 of the subdata comparator is released and the binary counter 4017 starts its counting operation. When the required comparison condition of the subdata comparator is satisfied at the time $t_{50}$ after the lapse of the time $t_s$, the level of the output signal of the subdata comparator rises, and the output signal of the comparator 4018*c* resets the R-S flip-flop 4300 [as shown in (k) of FIG. 14*a*] through the NAND gate 4029 of the data selector 4200 which is in the ON state [as shown in (i) of FIG. 14*a*], thereby causing the level of the output signal at the output terminal 4035 to fall [as shown in (d) of FIG. 14*a*]. The signal at the output terminal 4035 shown in (d) of FIG. 14*a* represents the ignition signal, and the time $t_{20}$ indicates the ignition coil energization starting timing, the time period $D_t$ the ignition coil energizing period and the time $t_{50}$ the ignition timing.

The above-mentioned ignition signal is amplified by the ignition coil driver circuit 10 to drive the ignition coil 20. A high voltage generated by the ignition coil 20 is distributed through the high-voltage distributor 4 to the spark plugs 3*a* to 3*d* in this order to effect the proper ignition. The ignition coil driver circuit 10 may be of the known type and it will not be described here.

As seen from the above-described embodiment, since the pulse width in angle of the pulsed angular signal is about 3.13° and hence the resolution is not high, in order to improve the precision of control by the system of this invention, the data $\theta_d$ and $\theta_s$ are divided into the angle data $\theta'_d$ and $\theta'_s$ and the time data $t_d$ and $t_s$, respectively, thereby to raise the precision of computation. However, if the angular width of the angular signal is reduced for example to 1° to obtain higher resolution, it will possible to attain the desired control precision by using the angle data alone. Further, if signals representative of the corresponding time lapse measured from the reference position of the engine are used in place of the data $\theta_d$ and $\theta_s$ it is necessary for the ESA comparator 400 only to count clock pulses having a repetition frequency suitable for the working range of rotational speeds of the engine thereby to attain satisfactory precision of control. It will thus be seen that the system of this invention is not limited to the above-described embodiment, but it is possible to attain satisfactory control by effecting the computation of the ignition coil energizing period, ignition timing, etc. by using only either one of angular signals and clock pulses.

Figure 14B:
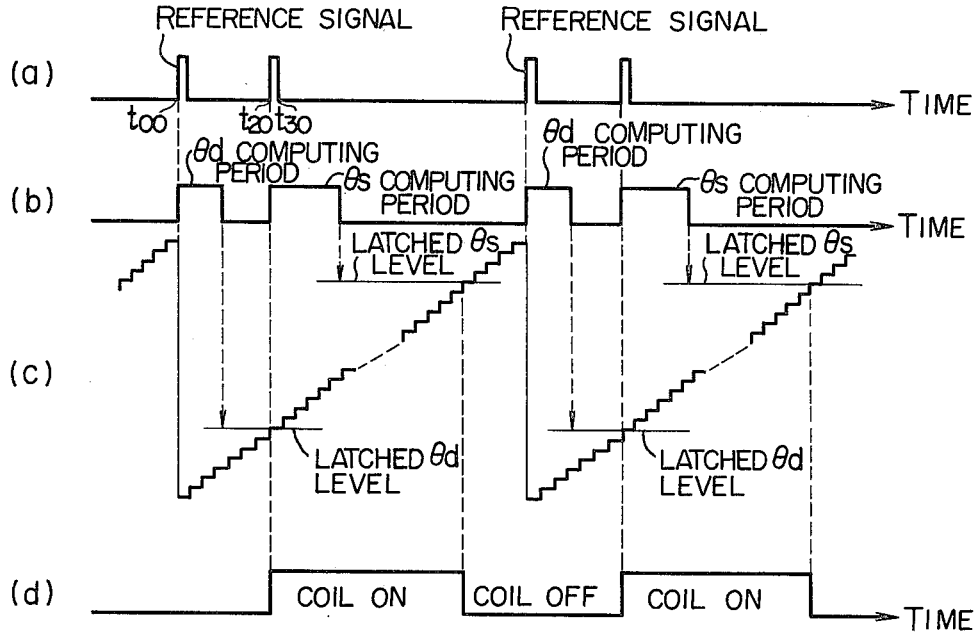
FIG. 14*b* is a supplementary diagram for explaining the relations between the operations of ESA comparator and the main computing unit.

FIG. 14*b* is a supplementary diagram useful for explaining, in a more easily understandable way, the relations between the operations of the ESA comparator 400 and the main computing unit 100 shown in FIG. 14*a*. However, in order to give easier understanding of the illustration, FIG. 14*b* shows, by way of example, a case where the angular width of the angular signal is reduced as mentioned previously thereby to attain the desired control of the ignition system with satisfactory precision by using the angle data alone. In the Figure, FIG. 14*b* (a) corresponds to FIG. 14*a* (a) and (e) and FIG. 14*b* (d) corresponds to FIG. 14*a* (d). As shown in FIG. 14*b* (b), when the computation of $\theta_d$, which has been initiated in the main computing unit 100 by a reference signal at the time $t_{00}$, is completed and the waveform showing the $\theta_d$ computing period falls, the computed value is stored in the latch circuits shown in FIG. 13. On the other hand, as shown in FIG. 14*b* (c), the counter in FIG. 13 starts the counting of the input pulses (i.e., the angular signals, here) simultaneously with the start of computation of $\theta_d$. When the count value of the counter reaches the level of the latched $\theta_d$ as shown in FIG. 14*b* (c), the ignition coil becomes energized as shown in FIG. 14*b* (d). At the instant when the ignition coil has become energized, the pulse signal shown in FIG. 14*a* (e) and also in FIG. 14*b* (a) is generated at the time $t_{20}$ to initiate the computation of $\theta_s$ by the main computing unit 100 as shown in FIG. 14*b* (b). When the computation of $\theta_s$ is completed, the resultant computed value is stored in the latch circuits shown in FIG. 13. On the other hand, the counter in FIG. 13 is continuing the counting of the input pulses even after the count value has reached the level of the latched $\theta_d$. When the count value reaches the level of the latched $\theta_s$ as shown in FIG. 14*b* (c), the ignition coil turns de-energized as shown in FIG. 14*b* (d) and an ignition spark is produced at this instant. Thereafter, the same process of operations is repeated.

Figure 15A:
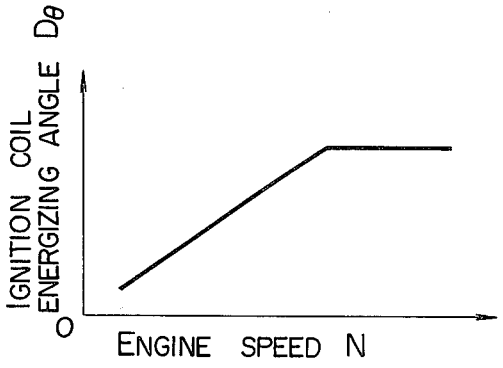
FIGS. 15*a* and 15*b* are graphs showing respectively the ignition coil energizing angle characteristic and the ignition coil energizing period characteristic programmed in the main computing unit in another embodiment of the system according to the invention.
Figure 15B:
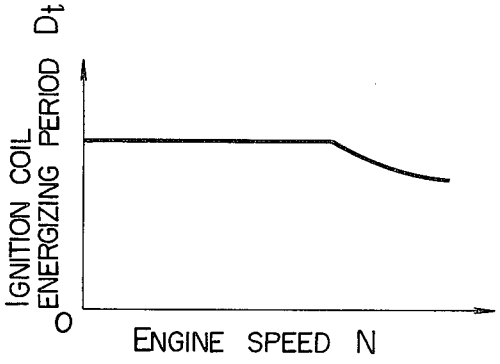

Next, another embodiment of the invention will be described. In the embodiment described above, the ignition coil energizing angle $D_\theta$ and the ignition coil energizing period $D_t$ are obtained from the operational equations. However, it may be possible to obtain either one of the ignition coil energizing angle $D_\theta$ and the ignition coil energizing period with respect to the engine rotational speed by the use of the same method as used for obtaining the advance angle versus engine rotational speed characteristic in the previously mentioned embodiment. More precisely, either one of the above-mentioned terms may be obtained firstly by obtaining the engine rotational speed N by computing the reciprocal of the output 1/N of the rotational speed detecting circuit 130 and then applying the resultant value of the engine rotational speed N to either one of the ignition coil energizing angle $D_\theta$ versus engine rotational speed characteristic (FIG. 15*a*) and the ignition coil energizing period $D_t$ versus engine rotational speed characteristics (FIG. 15*b*) which have beforehand been programmed and stored in the memory. Then, in a case where the ignition coil energizing angle $D_\theta$ has been obtained, the resultant value per se may be used, whereas, in the other case where the ignition coil energizing period has been obtained, the corresponding ignition coil energizing angle may be obtained by the computation based on the equation (1) in the first embodiment, and thereafter the other computations and operations may be followed in the same way as the first embodiment, thereby attaining the desired control of the ignition coil energizing period $D_t$.

While the preferred embodiments of the invention have been described as applied to the four-cylinder four-cycle engines, the invention is also applicable to other engines having 6 or 8 cylinders, in which case the reference pulse reshaping circuit 120 should generate an output at every 120 degrees of crankshaft rotation for the six-cylinder engine or at every 90 degrees of crankshaft rotation for the eight-cylinder engine. Further, if the reference position detector 1 is designed to generate a plurality of reference pulse signals corresponding to the number of engine cylinders, the reference pulse reshaping circuit 120 may be constructed only with the circuit shown in FIG. 3 which operates simply to reshape the input signal.

The features of the operations of the electronically controlled ignition system of this invention may be summarized as follows:

(1) The digital computer 100 starts the computation of the ignition coil energization starting angle $\theta_d$ in synchronism with a reference position signal, and it also starts the computation of the igntion angle $\theta_s$ (ignition coil de-energizing angle) in response to the signal from the ignition interrupt generating circuit 300 (which is synchronized with the start of the energization of the ignition coil). These computations are performed repeatedly.

(2) The previously computed value of $\theta_s$ is utilized in the computation of the ignition coil energization starting angle $\theta_d$ in order to make the ignition coil energizing period have a desired value (e.g., a fixed time period).

(3) The single ESA comparator 400 comprising the latches, comparators and counters is provided to drive the ignition coil 20 by using the values of $\theta_s$ and $\theta_d$ computed by the computer. The counters are reset by the reference position signal to start the counting of the input pulses. The resultant count values are utilized to be compared with both of the values $\theta_s$ and $\theta_d$ which are alternately stored in the latches.

It will thus be seen from the foregoing descriptions that the ignition system of this invention comprises rotational angle detecting means for detecting an angular pulse each time an internal combustion engine rotates through a predetermined angle, timing pulse generating means for detecting a reference angular position of the engine to generate a reference position pulse, a main computing unit for computing the desired ignition coil de-energizing timing and the ignition coil energization starting timing in accordance with a plurality of engine operating condition parameters, and an ignition coil control circuit responsive to the angular pulses to convert the ignition coil energization starting timing data and the ignition coil de-energizing timing data into the corresponding pulse width in relation to the rotational angle of the engine, whereby signals for initiating the computations of the ignition coil energization strating timing and the ignition coil de-energizing timing are obtained through the computations by the main computing unit triggered by externally applied signals, and the ignition coil energization starting timing data and the ignition coil de-energizing timing data are transferred to the ignition coil control circuit from the main computing unit in response to the two externally applied signals occurring at different times.

The ignition system of this invention provides a great advantage such that the ignition coil energization starting timing and the ignition coil de-energizing timing can be controlled with high precision by using only a single set of ignition coil control circuit.

The ignition system of this invention also provides another great advantage such that, if the output pulse of the timing pulse generating means corresponding to a predetermined crank angle is used as one of the two signals applied at different times to effect the transfer of the ignition coil energization starting timing data and if the output signal of the ignition coil control circuit is used to effect the transfer of the ignition coil de-energizing timing data to the ignition coil control circuit, there is no necessity to provide any additional circuit or circuits for generating the two signals to be applied at different times and besides any waste of time can be avoided, thereby enabling the control of an ignition system with a quick response and high precision.

We claim:

1. An ignition system for an internal combustion engine having a rotatable output shaft comprising:

an ignition coil energized and de-energized in synchronized relation with a first and second timing signals, respectively, to generate ignition voltages;

a position detector for generating a reference position signal at every arrival of said output shaft at a predetermined reference position;

a periodic pulse generator for generating periodic pulsed signals in each period of time between two successive reference position signals;

a digital computer being programmed to compute a first and second values in synchronized relation with said reference position signal and said first timing signal, respectively, said first value being indicative of the desired ignition coil energization starting timing and computed by using said second value so that an ignition coil energizing period is kept at a desired value, and said second value being indicative of the desired coil de-energizing timing and computed to vary in accordance with operating conditions of said internal combustion engine;

a latch for sequentially latching said computed first value and said computed second value at the respective timings when the computation of the first and second values is completed in said digital computer;

counter means for counting said periodic pulse signals after being reset in synchronized relation with said reference position signal; and a comparator for sequentially comparing the count output of said counter means with said latched first and second values, said comparator generating said first timing signal to be supplied to said ignition coil and said digital computer when said count output reaches said latched first value and then generating said second timing signal to be supplied to said ignition coil when said count output reaches said latched second value.

2. An ignition system for an internal combustion engine having a rotatable output shaft according to claim 1, wherein said periodic pulsed signals generated by said periodic pulse generator comprise at least one of angular signals and clock pulse signals.

3. An ignition system for an internal combustion engine having a rotatable shaft according to claim 1, wherein said first and second values are computed alternately by a single digital computer and are applied alternately to a single comparator.

4. An ignition system for an internal combustion engine having a rotatable output shaft according to claim 1, further comprising ignition coil driver means receiving said first and second timing signals from said comparator, amplifying said signals and supplying said signals to said ignition coil.

5. An ignition system for an internal combustion engine having a rotatable output shaft according to claim 1, wherein said desired value of the ignition coil energization period is a substantially constant value.

6. A method of controlling the generation of an ignition voltage by an ignition coil of an internal combustion engine having an output shaft, said method comprising the steps of:

detecting the arrival of said output shaft of said internal combustion engine at a predetermined rotational position and then generating a reference position signal;

generating a train of periodic signals;

initiating, in response to said reference position signal, the counting by counter means of said periodic signals;

initiating, in response to said reference position signal, the computation by programmed digital computer means of a first delay period between said predetermined position and a desired ignition coil energization starting position to generate a first digital value indicative of said first delay period;

storing said first digital value in storage means of said computer means after the completion of computation of said first delay period;

generating a first signal when the count of said counter means reaches said stored first digital value;

intiating, in response to said first signal, the energization of said ignition coil;

initiating, in response to said first signal, the computation by said programmed digital computer means of a second delay period between said predetermined position and a desired ignition coil de-energizing position to generate a second digital value indicative of said second delay period;

storing said second digital value in said storage means of said computer means in place of said first digital value after the completion of computation of said second delay period;

generating a second signal when the count of said counter means reaches said stored second digital value;

initiating, in response to said second signal, the de-energization of said ignition coil to generate said ignition voltage; and repeating the sequential operations of the above-described steps.

* * * * *